US007228083B2

(12) United States Patent
Iwakawa

(10) Patent No.: US 7,228,083 B2
(45) Date of Patent: Jun. 5, 2007

(54) IMAGE FORMING APPARATUS

(75) Inventor: Tadashi Iwakawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 11/114,157

(22) Filed: Apr. 26, 2005

(65) Prior Publication Data

US 2005/0244177 A1 Nov. 3, 2005

(30) Foreign Application Priority Data

Apr. 28, 2004 (JP) ..... 2004-132961

(51) Int. Cl.
*G03G 15/00* (2006.01)

(52) U.S. Cl. ..... 399/49; 399/15; 399/72

(58) Field of Classification Search ..... 399/49, 399/15, 60, 72, 16; 347/19
See application file for complete search history.

(56) References Cited

U.S. PATENT DOCUMENTS 6,961,526 B2 * 11/2005 Tezuka et al. ..... 399/15
7,036,737 B2 * 5/2006 Nakayama et al. ..... 399/49 X

FOREIGN PATENT DOCUMENTS

JP 2000-132013 5/2000
JP 2003-287934 A * 10/2003

* cited by examiner

*Primary Examiner*—Sophia S. Chen
(74) *Attorney, Agent, or Firm*—Fitzpatrick, Cella, Harper & Scinto

(57) ABSTRACT

An image forming apparatus having an image forming portion, a sheet conveyance path, an image density detection portion for detecting density of the image formed on the conveyed sheet, and a control portion for performing density adjustment of the image formed on the sheet using detection information. The image forming portion can form a test pattern image on the sheet. The test pattern image has a reference image formed in a predetermined density, and the image forming portion forms the test pattern on the sheet such that the reference image is not formed at positions in the sheet. The positions are located at the same distances away from a front end of the sheet in a conveyance direction as distances between the image density detection portion and points where entry shock of the sheet front-end is generated, in the sheet conveyance path on the downstream side of the image density detection portion.

17 Claims, 6 Drawing Sheets

IMAGE FORMING APPARATUS

BACKGROUND OF THE INVENTION

1. Field of the Invention

The present invention relates to an image forming apparatus, such as a copying machine, a printer, and a facsimile, in which an image is formed by utilizing an electrophotographic type, an inkjet type, and the like. Particularly the invention relates to the image forming apparatus which can detect density of the image on the recording medium to perform image density adjustment.

2. Description of the Related Art

As is well known, in the electrophotographic type image forming apparatus, a visible image borne on a photosensitive drum or an intermediate transfer member is transferred to a recording medium (sheet) such as plain paper to obtain a recording image. Therefore, the recording medium to which the visible image is transferred from the photosensitive drum or the intermediate transfer member is conveyed to a fixing unit to subject to the fixation of the visible image. Then, the recording medium is discharged.

Recently, the needs for a high-quality image and a high-stabilization image are being increased in the image forming apparatus. In order to always keep the density of the image formed by the image forming apparatus an appropriate state, there are proposed many technologies which perform image density control. For example, in the conventional technology, a reference image having predetermined density is formed, the density of the reference image is measured, the measured value of the reference image is compared to a predetermined target density value to produce a conversion table, and the density control of the image is performed by converting density characteristics of image data with the conversion table.

Usually the reference image density necessary for the density control is measured before a toner image is transferred to the record medium, or namely, the reference image is formed on the photosensitive drum or the intermediate transfer member to measure the density of the reference image. The toner image is the visible image formed as the reference image. However, in the density measuring method, due to the fluctuation in toner amount to the recording medium and the fluctuation in degree of fixation of the toner, there is generated difference in density between the image on the actually obtained recording medium and the measured image on the photosensitive drum or the intermediate transfer member. Therefore, density control cannot be performed with high accuracy.

In order to solve the above problem, there is proposed the image forming apparatus, in which the reference image is previously formed in the recording medium, an image reading unit reads the reference image, and the image density is controlled based on the read result of the reference image. Further, Japanese Patent Application Laid-Open No. 2000-132013 discloses the image forming apparatus, in which an optical density sensor is provided in a conveyance path for the recording medium after the transfer or fixation, the density sensor detects the reference image previously formed on the recording medium during conveyance, and image density adjustment is performed based on the detection information.

In the inkjet type image forming apparatus, the image density is also changed by variation with time and environmental difference of the amount of ink ejection, individual differences of ink cartridges, and the like. Therefore, there is proposed the image forming apparatus, in which the optical density sensor is arranged near a discharge unit of the image forming apparatus, the density sensor detects the density of the image on the recording medium during the conveyance, and image density adjustment is performed based on the detection information.

However, in many reference images formed by the conventional image forming apparatus, plural reference patches are arranged at regular intervals in the recording medium conveyance direction, and the reference patches arranged at regular intervals are detected at constant timing by the density sensor. Therefore, the following problem is generated.

When the test pattern image in which the plural reference patches is detected at regular intervals, because a recording medium front-end enters the bent conveyance path, a roller pair and a sensor flag in the conveyance path, and the like while the density sensor measures the density, the recording medium fluctuates (vibrates) in a vertical direction (direction in which the recording medium is brought close to and separated from the density sensor) with respect to the density sensor. Therefore, sometimes the density measurement is difficult to perform with high accuracy. This is because usually an output value of the optical density sensor is largely changed when a measurement object fluctuates vertically.

In order to suppress the vertical fluctuation of the recording medium, it is thought that an allowance for the vertical fluctuation of the recording medium is widened in the density sensor by using an optical system combining a light source, a lens, and a light reception element for the density sensor. Therefore, large effect can be obtained by increasing a lens diameter or using plural lenses.

However, the above countermeasure leads to upsizing of the density sensor, the increase in the cost of components, the increase in the number of components, and the increase in the man-hour, which results in the problems that the density sensor size is increased and production cost for the density sensor is increased. These problems also become a large obstacle to downsizing and cost reduction in the image forming apparatus as a whole. Further, in the countermeasure, only the allowance for the vertical fluctuation of the recording medium is widened in the density sensor, so that the image density adjustment is difficult to perform with high accuracy in the system in which the recording medium largely fluctuated in the vertical direction.

SUMMARY OF THE INVENTION

In view of the foregoing, an object of the invention is to provide an image forming apparatus, in which influence of the vertical fluctuation of the recording medium is avoided to perform the image density adjustment with high accuracy and both the cost reduction and the downsizing are achieved.

In order to achieve the object, an image forming apparatus of the invention includes an image forming portion which forms an image on a sheet, wherein the image forming portion can form a test pattern image on the sheet, the test pattern image having a reference image formed in a predetermined density; sheet conveyance means for conveying the sheet on which the image is formed by the image forming portion; image density detection means disposed on said sheet conveyance path for detecting density of the test pattern image formed on the sheet; and control means for performing density adjustment of the image formed on the sheet based on a detection information of the image density detection means, wherein the image forming portion forms the test pattern on the sheet such that the reference image is not formed at positions in the sheet, the positions are located at the same distances away from a front end of the sheet in a conveyance direction as distances along the conveyance path between the image density detection means and points where entry shock of the sheet front end is generated, in the sheet conveyance path on the downstream side of the image density detection means.

Further, an image forming apparatus of the invention includes an image forming portion which forms an image on a sheet, wherein the image forming portion can form a test pattern image on the sheet, the test pattern image having a reference image formed in a predetermined density; conveyance means for conveying the sheet on which the image is formed by the image forming portion; image density detection means disposed on said sheet conveyance path for detecting density of the image formed on the sheet; and control means for performing density adjustment of the image formed on the sheet based on a detection information of the image density detection means, wherein the image density detection means does not perform the density detection of the reference image in the test pattern image, when a front end of the sheet in a conveyance direction is located at positions where entry shock of the sheet front-end is generated, in a sheet conveyance path on the downstream side of the image density detection means.

Further, an image forming apparatus of the invention includes an image forming portion which forms an image on a sheet, wherein the image forming portion can form a test pattern image on the sheet, the test pattern image having a reference image formed in a predetermined density; conveyance means for conveying the sheet on which the image is formed by the image forming portion; image density detection means disposed on said sheet conveyance path for detecting density of the image formed on the sheet; and control means for performing density adjustment of the image formed on the sheet based on a detection information of the image density detection means, wherein the image density detection means does not use the density detection information as the image density adjustment, even if the density detection of the reference image in the test pattern image is performed, when a front end of the sheet in a conveyance direction is located at positions where entry shock of the sheet front end is generated, in a sheet conveyance path on the downstream side of the image density detection means.

DESCRIPTION OF THE PREFERRED EMBODIMENT

Figure 1:
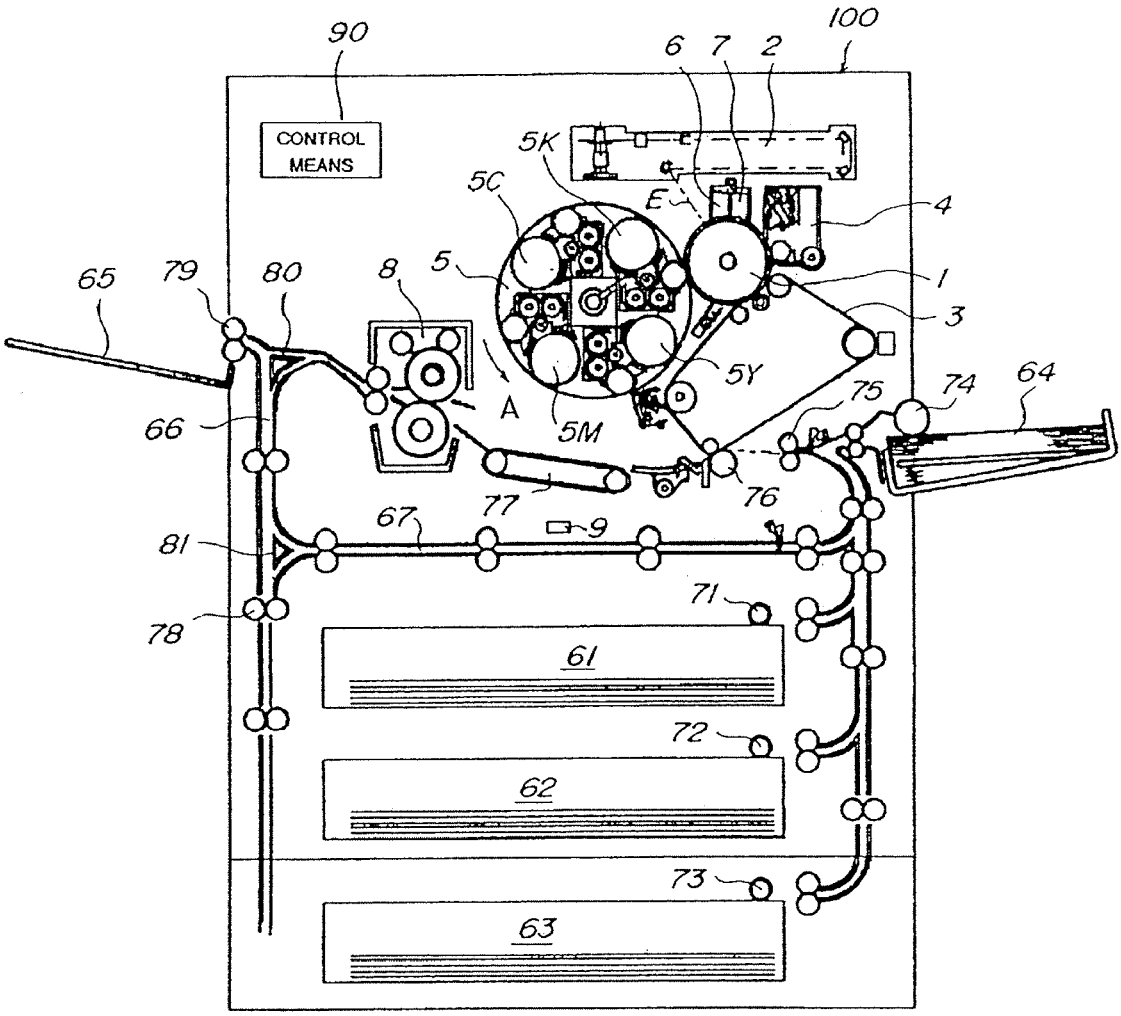
FIG. 1 is a main sectional view showing an image forming apparatus according to an embodiment.

Referring to the drawings, an image forming apparatus according to a preferred embodiment of the invention will be described below.

The image forming apparatus, in which an intermediate transfer member is used, the toner images of colors are transferred to the intermediate transfer member while sequentially superposed on the intermediate transfer member, and the toner images borne on the intermediate transfer member are collectively transferred to the recording medium (sheet) such as plain paper and coated paper, will be taken as illustration of the embodiment. However, the invention is not particularly limited to the embodiment. For example, it is also possible that the invention is applied to the image forming apparatus, in which a recording medium bearing member is used and the toner images of colors are transferred to the recording medium by sequentially superposing the toner images of colors on the recording medium borne by the recording medium bearing member. Further, the printer is illustrated as an example of modes of the image forming apparatus. However, the image forming apparatus is not limited to the printer. Examples of the image forming apparatus include the copying machine, the facsimile, and a multi-function peripheral in which the functions of the printer, the copying machine, and the facsimile are integrated.

Shapes of constituents and relative arrangement of the constituents, where are described in the embodiment, should appropriately be changed depending on various conditions and the configuration of the apparatus to which the invention is applied. Therefore, it should be understood that the scope of the invention is not limited to the following illustrations.

[Schematic Configuration of Image Forming Apparatus]

FIG. 1 is a schematic sectional view showing an image forming apparatus in which an electrophotographic type according to the embodiment of the invention is utilized.

As shown in FIG. 1, an image forming apparatus 100 according to the embodiment includes an image forming portion and conveyance means. The image forming portion includes an electrophotographic photosensitive drum 1 (hereinafter referred to as photosensitive drum) which is of an image bearing member rotated at constant speed. The conveyance means conveys the recording medium to the image forming portion, and the conveyance means conveys the recording medium in which the image is formed by the image forming portion.

In the image forming apparatus, as shown in FIG. 1, a pre-exposure lamp 6, a charger 7, a laser exposure optical system 2, a rotating type development member 5, an intermediate transfer member 3, a cleaning unit 4, and the like are arranged around the photosensitive drum 1. The pre-exposure lamp 6 performs static elimination of the photosensitive drum 1. The charger 7 evenly charges a surface of the photosensitive drum 1. The laser exposure optical system 2 forms latent images on the photosensitive drum 1. The rotating type development member 5 causes the toner to adhere to the latent images on the photosensitive drum 1 to develop the latent images as the toner images. The toner images formed on the photosensitive drum 1 are sequentially transferred to the intermediate transfer member 3, and the intermediate transfer member 3 bears the toner images. The cleaning unit 4 removes the toner remaining on the surface of the photosensitive drum 1 after the transfer.

The rotating type development member 5 has four-color development units, i.e. a development unit 5K for black, a development unit 5Y for yellow, a development unit 5M for magenta, and a development unit 5C for cyan. The rotating type development member 5 is rotated in an arrow "A" direction in FIG. 1 about a cylindrical rotating shaft provided in center of the development member 5. The rotating type development member 5 can move the desired development unit to a development position opposite the photosensitive drum 1 as necessary.

For the image formation, after the photosensitive drum 1 is rotated to perform the static elimination with the pre-exposure lamp 6, the photosensitive drum 1 is evenly charged by the charger 7. The photosensitive drum 1 is irradiated with a first-color light image E using the laser exposure optical system 2, and the latent image is formed on the photosensitive drum 1. The latent image on the photosensitive drum 1 is developed by the first-color development unit to form the toner image on the photosensitive drum 1. The toner is mainly made of resin and pigment. Then, the toner image formed on the photosensitive drum 1 is primarily transferred to the intermediate transfer member 3.

When the first-color development is finished, the rotating type development member 5 is rotated in the arrow "A" direction by 90°, and the second-color development unit is moved to the development position opposite the photosensitive drum 1. After the first-color primary transfer, the photosensitive drum 1 is cleaned by the cleaning unit 4. As with the first-color, the photosensitive drum 1 repeats the latent image formation, the development, and the primary transfer for the second color, the third color, and the fourth color to superpose the toner images of the first to fourth colors on the intermediate transfer member 3.

On the other hand, the conveyance means for conveying the recording medium individually and selectively feeds the recording medium stored in each of storage units 61, 62, 63, and 64 by each of feed rollers 71, 72, 73, and 74. Skew of the recording medium is corrected by registration rollers 75, and the recording medium is conveyed to a secondary transfer unit 76 at desired timing. The toner images superposed on and transferred to the intermediate transfer member 3 are collectively transferred (secondary transfer) to the recording medium conveyed to the secondary transfer unit 76. The recording medium to which the toner images are transferred by the secondary transfer unit 76 passes through a conveyance unit 77, the toner images are fixed by a fixing unit 8, and the recording medium is discharged onto a discharge tray 65 by the discharge rollers 79.

When the images are formed on both the surfaces of the recording medium, after the recording medium passes through the fixing unit 8, the recording medium is temporarily guided to a reverse path 66 by a first switching guide. The recording medium guided to the reverse path 66 is conveyed in the opposite direction to the direction in which a rear end of the recording medium is delivered as the front end by the reverse rotation of a reverse roller 78, and the recording medium is conveyed to a sheet re-feeding path 67 through a second switching guide 81. Then, the recording medium is conveyed to a registration roller 75 through the sheet re-feeding path 67, and the recording medium is delivered to the image forming portion again to transfer the image onto the other surface.

The image forming apparatus has a density sensor 9 which is of image density detection means for detecting the density of the image formed on the recording medium. In the embodiment, the reflection type density sensor 9 which is of the image density detection means is arranged on the sheet re-feeding path 67 which is of the recording medium conveyance path. The image forming apparatus performs the later-mentioned image density adjustment using detection information of the density sensor 9. In FIG. 1, the reference numeral 90 denotes control means for controlling operation of each unit constituting the image forming apparatus 100. The control means 90 performs the density adjustment of the image, which is formed on the recording medium by the image forming portion including the fixing unit 8, based on the detection information of the density sensor 9.

[Image Density Adjustment]

Figure 2:
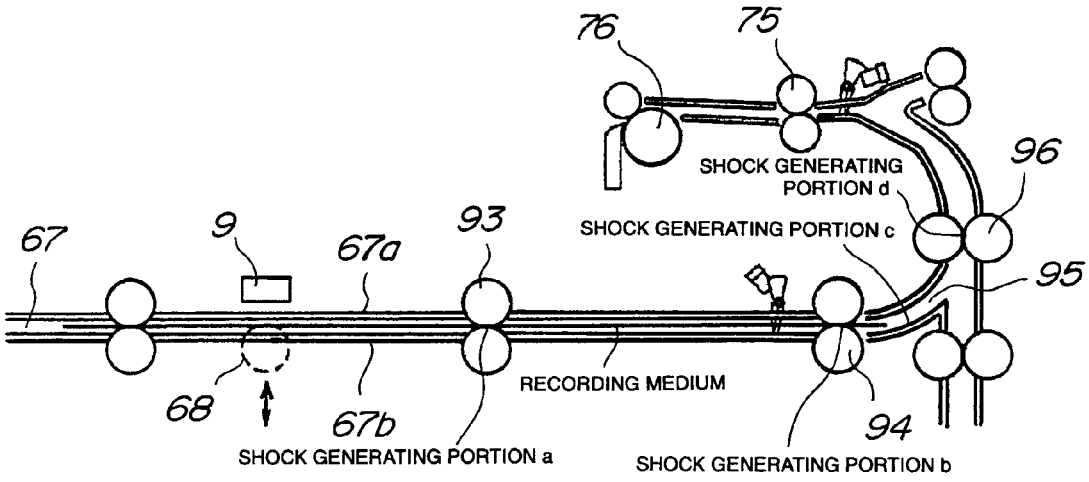
FIG. 2 is a sectional side view showing an arrangement of a density sensor in a recording medium conveyance path in the image forming apparatus of FIG. 1.
Figure 3:
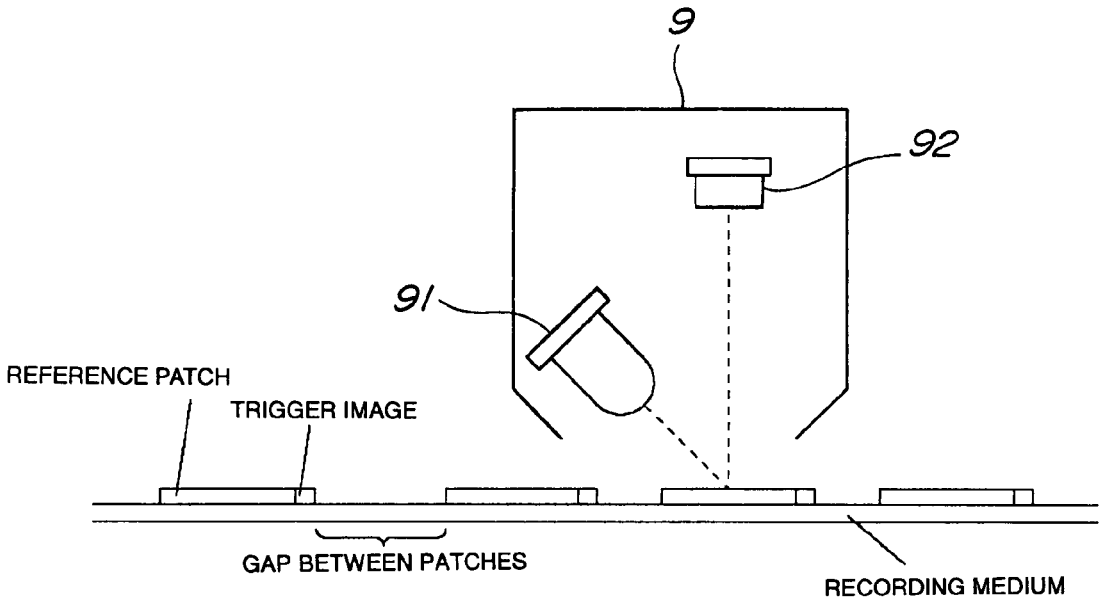
FIG. 3 is a sectional side view showing the density sensor and the recording medium in the image forming apparatus of FIG. 1.
Figure 4:
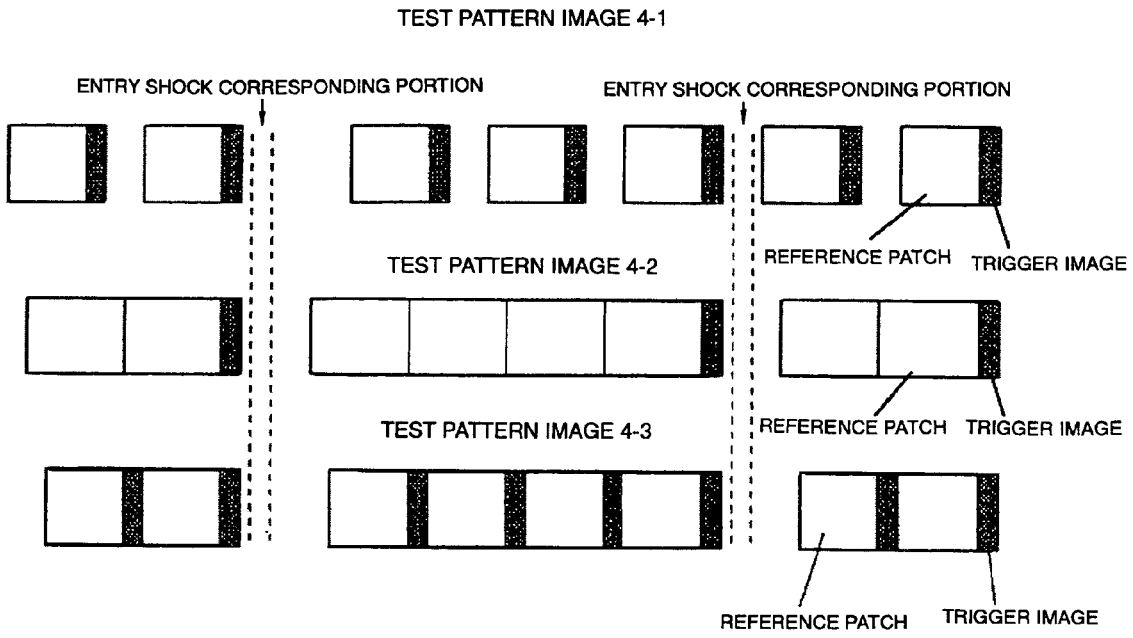
FIG. 4 is a schematic view showing an example of a test pattern image according to the embodiment.
Figure 5:
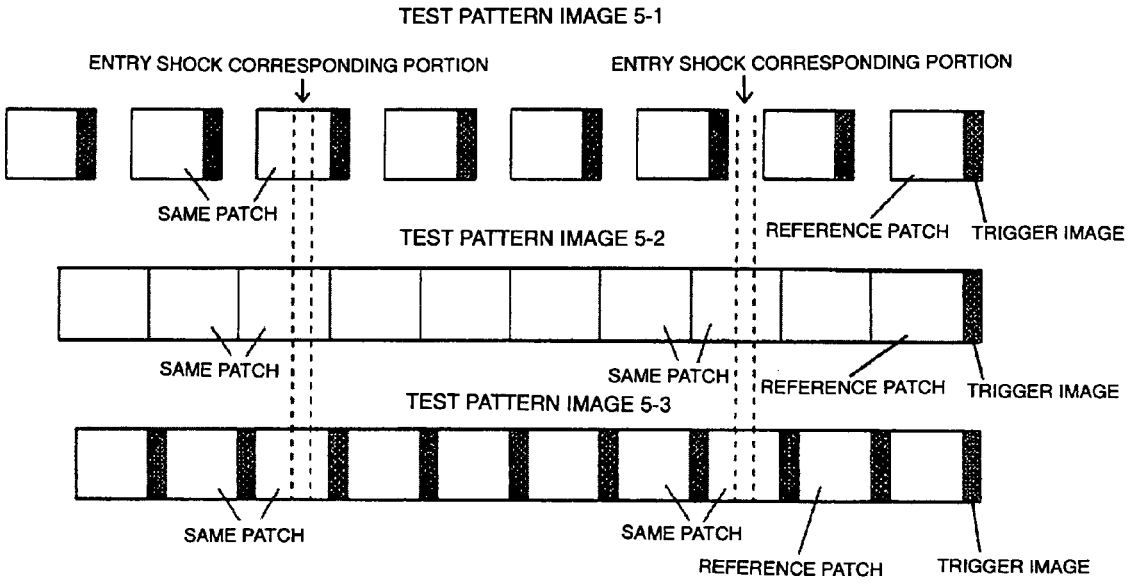
FIG. 5 is a schematic view showing an example of a test pattern image according to the embodiment.
Figure 6:
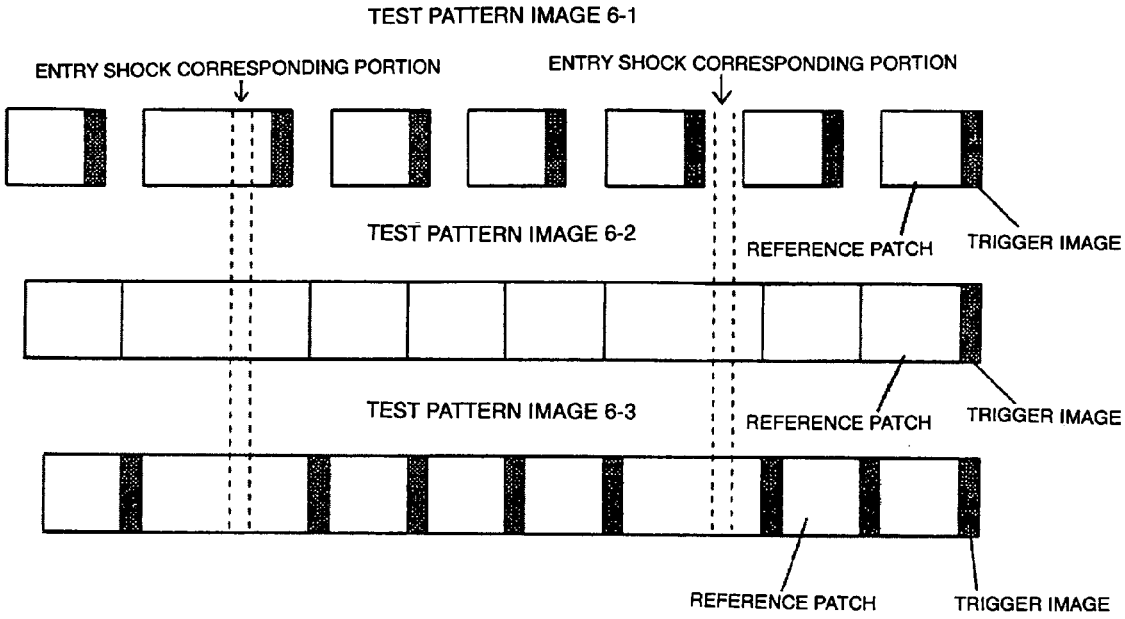
FIG. 6 is a schematic view showing an example of a test pattern image according to the embodiment.

The image density adjustment in the image forming apparatus will be described in detail. FIG. 2 is a sectional side view showing an arrangement of the density sensor in the recording medium conveyance path. FIG. 3 is a sectional side view showing the density sensor and the recording medium. FIGS. 4 to 6 are a schematic view showing an example of a test pattern image.

During the image density adjustment, the image forming portion forms the test pattern image shown in FIGS. 4 to 6 on the recording medium. The test pattern image includes a reference patch and a trigger image. The reference patch is a reference image formed in a predetermined density, and the detection of the reference patch is started by the trigger image. Plural combinations of the reference patches and the trigger images are arranged in the test pattern image. As with the normal both-side image formation, in the image density adjustment, the latent image formation, the development, and the primary transfer are repeated and the recording medium is conveyed to the secondary transfer unit. Then, the test pattern image (toner image) is transferred to the recording medium, and the transferred test pattern image is fixed onto the recording medium by the fixing unit 8.

The recording medium in which the test pattern image is formed is guided to the reverse path 66 by the first switching guide 80. Then, the recording medium is reversed by the reverse roller 78, and the recording medium is delivered to the sheet re-feeding path 67 in which the density sensor 9 is arranged as shown in FIG. 2.

As shown in FIG. 3, in the recording medium delivered to the sheet re-feeding path 67, the trigger image which becomes a reference of the detection start is detected by the density sensor 9 when the recording medium passes through the density sensor 9. Then, the image density of the reference patch is detected. Namely, when the density sensor 9 detects the trigger image in the test pattern image, the density sensor 9 irradiates the reference patch on the recording medium conveyed at predetermined timing with reference light using irradiation means 91 in the density sensor 9. The light reflected from the recording medium is received by light-reception means 92, and the density sensor 9 outputs a signal according to a light quantity. The control means 90 produces a conversion table by comparing density measurement values obtained from output values of the density sensor 9 to a predetermined density target value. The control means 90 converts density characteristics of the image data to perform the image density adjustment using the conversion table.

As shown in FIG. 2, sometimes the recording medium passing through the density sensor 9 fluctuates (vibrates) in a vertical direction in which the recording medium is brought close to or separated from the density sensor 9 by the entry shock. The entry shock is generated when the front end of the recording medium enters a conveyance roller pair 93 (shock generating portion a), a conveyance roller pair 94 (shock generating portion b), a bent conveyance path 95

(shock generating portion c) and a conveyance roller pair 96 (shock generating portion d) in the recording medium conveyance path on the downstream side of the density sensor 9. Hereinafter the point affected by the entry shock of the recording medium front-end is referred to as entry shock generating portion.

In the embodiment, when the image forming portion forms the test pattern image on the recording medium, as shown in FIG. 4, the reference patch is not formed at positions in the recording medium so that a gap is formed between the reference patches. The positions are located at the same distances away from the front end of the recording medium in the conveyance direction as distances between the density sensor 9 and the points where the entry shock of the recording medium front-end is generated (distances between the density sensor 9 and the entry shock generating portions a to d in FIG. 2), in the recording medium conveyance path on the downstream side of the density sensor 9. Therefore, when the recording medium passing through the density sensor 9 fluctuates vertically by the entry shock, because the density sensor 9 does not detect the image density of the recording medium, detection accuracy can be prevented from worsening.

In the embodiment, the entry shock generating portions a to d shown in FIG. 2 are illustrated as the cause of the entry shock of the recording medium passing through the density sensor 9 and the entry shock generating portions. However, the cause of the entry shock and the entry shock generating portions are not limited to the entry shock generating portions a to d shown in FIG. 2. The entry shock generating portion depends on the configuration of the conveyance path in the image forming apparatus. However, in each configuration of the image forming apparatus, the entry shock generating portion can previously estimated from the structure of the conveyance path on the downstream side of the density sensor 9 in the conveyance direction. Therefore, the test pattern image in which the reference patch is not formed at the position in the recording medium which is located at the density sensor 9 when the recording medium front-end reaches the entry shock generating portion can previously be prepared. The positions in the recording medium which are located at the density sensor 9 when the recording medium front-end reaches the entry shock generating portions a to d are referred to as entry shock corresponding portion. Namely, in the sheet re-feeding path on the downstream side of the density sensor 9, the entry shock corresponding portions are the positions which are located at the same distances away from the front end of the recording medium in the conveyance direction as distances between the density sensor 9 and the points where the entry shock of the recording medium front-end is generated. The entry shock corresponding portions are shown in FIGS. 4 to 6.

According to the embodiment, thus, the influence of the vertical fluctuation of the recording medium can be avoided or reduced only by previously preparing the test pattern image in which the reference patch is not formed in the entry shock corresponding portion corresponding to the entry shock generating portion. Therefore, cost increase and upsizing caused by addition of components can be avoided.

The test pattern image, in which the reference patch is not formed at the position affected by the entry shock and the gap is provided between the reference patches, is illustrated in the embodiment. However, in the case where the detection of the trigger image is not affected before the detection start while the entry shock affects the output value of the trigger image, it is possible that the trigger image is provided at the position affected by the entry shock. Therefore, in the actual image density detection, the density adjustment can be performed with high accuracy with no influence of the entry shock, and it is not necessary that the gap is provided between the reference patches, so that a space on the recording medium can be effectively utilized.

In the image forming apparatus of the embodiment, the density sensor 9 is provided in the substantially horizontal sheet re-feeding path 67. Therefore, when compared with the configuration in which the density sensor 9 is provided in the bent conveyance path or the vertical conveyance path, the number of positions affected by the entry shock of the recording medium front-end can be reduced, and a range where the density detection cannot be performed can be kept to a minimum. The position of the density sensor 9 is located on the downstream side of the fixing unit 8, so that the density adjustment can be performed with the image after the fixation. Therefore, since a degree of the fixation of the image affects the density adjustment, the density adjustment can be performed at higher accuracy. Further, the position of the density sensor 9 is separated from the fixing unit 8 to a certain extent, so that the density of the post-fixation image in which the density is stabilized can be detected when compared with the configuration in which the density sensor 9 is arranged immediately behind the fixing unit 8. Therefore, the density can be detected more stably.

In the embodiment, as shown in FIG. 2, the density sensor 9 is arranged on the side of a guide member 67*a* of a pair of guide members 67*a* and 67*b* constituting the sheet re-feeding path 67. In the arrangement position of the density sensor 9, it is possible to provide a backup roller 68 which is of a pressing member for pressing the recording medium against the guide member 67*a* on the side where the density sensor 9 is arranged, or it is possible to provide the backup roller 68 which presses the recording medium against the guide member 67*b* on the opposite side to the side where the density sensor 9 is arranged.

The backup roller 68 is provided so as to be able to intrude in and retract from the sheet re-feeding path 67 by a solenoid (not shown). The backup roller 68 intrudes in the sheet re-feeding path 67 from a retracted position to press the recording medium against the guide member 67*a* at predetermined timing since the front end of the recording medium passes through the density sensor 9.

The backup roller 68 is formed by sponge and the like, and the backup roller 68 presses the recording medium with a broad nip so that a flat surface is formed as large as possible in the conveyance direction of the recording medium. Therefore, even if a mounting error of the density sensor 9 exists in the conveyance direction of the recording medium, the density sensor can detect the density at the accurate position.

Thus, the provision of the pressing member such as the backup roller 68 secures the gap between the density sensor 9 and the recording medium, which allows the recording medium to fluctuate while the recording medium passes through the density sensor 9. Therefore, the accuracy of the image density adjustment can be further improved.

The pressing member is not limited to the rotating member such as the backup roller. For example, it is also possible to use the pressing members such as a plate spring formed in an arc shape.

After the image density detection, the recording medium in which the test pattern image is formed is discharged to the discharge tray 65 through the registration rollers 75, the secondary transfer unit 76, and the fixing unit 8.

[Test Pattern Image]

Referring to FIG. 4, the test pattern image formed on the recording medium by the image forming portion will be described in detail.

In a test pattern image 4-1 shown in FIG. 4, the trigger images are formed in front of all the reference patches formed on the recording medium, and the gap is provided between each reference patch and the trigger image in front of the next reference patch (hereinafter referred to as patch gap). In the case where the position where the patch gap is provided does not correspond to the entry shock corresponding portion, the patch gap is widened.

In the test pattern image 4-1, after the density sensor 9 detects the trigger image, the density sensor 9 performs the density detection of the reference patch immediately behind the trigger image. In the test pattern image, when the reference patch corresponds to the entry shock corresponding portion, the reference patch is not provided in the entry shock corresponding portion, but the patch gap is provided. Further, the patch gap is widened so as to avoid the entry shock corresponding portion. Therefore, the image density adjustment can be performed with no influence of the entry shock. When a degree of freedom exists in the arrangement of the conveyance roller pair, the shape of the guide member constituting the conveyance path, and the arrangement of the density sensor 9, it is possible that the conveyance roller pair arrangement, the guide member shape, and the density sensor arrangement are configured so that the patch gap is previously located at the position affected by the entry shock. Therefore, the influence of the entry shock can be avoided without widening the patch gap too much.

In a test pattern image 4-2 shown in FIG. 4, the plural reference patches are formed behind one trigger image. In the test pattern image 4-2, after the density sensor 9 detects the trigger image, the density sensor 9 performs the density detection for the continuous reference patches at constant intervals. In the test pattern image 4-2, the number of trigger images can be kept to a minimum. For the test pattern image 4-2, because the recording medium is conveyed at constant speed and the density detection is performed in the desired reference patch, it is preferable to configure a conveyance mechanism which can convey the recording medium with high accuracy, or it is preferable to form the reference patch having a size in which variations in conveyance speed can be permitted.

In the test pattern image 4-2, the reference patch is not provided in the entry shock corresponding portion, but the patch gap is provided. Further, the trigger image and the plural reference patches are formed behind the patch gap. Therefore, the influence of the entry shock can be avoided. As with the test pattern image 4-2, in the system in which the density detection is performed for the plural reference patches is performed at the desired timing from a certain reference, it is possible that detection means (already-existing sensor or separately installed sensor) located on the upstream side of the density sensor in the conveyance direction is utilized to start the density detection of the reference patch in the test pattern image at predetermined timing based on the detection of the detection means. Therefore, the density detection can be started without providing the trigger image. Namely, it is not always necessary that the test pattern image has the trigger image, and it is possible that the test pattern image includes the reference patch.

In a test pattern image 4-3 shown in FIG. 4, the trigger images are formed in front of all the reference patches, and the patch gap is provided only at the position corresponding to the entry shock corresponding portion. Unlike the test pattern image 4-1 in which the patch gap is provided between each reference patch and the trigger image in front of the next reference patch, the patch gap is provided only at the position corresponding to the entry shock corresponding portion.

In the test pattern image 4-3, because the patch gap is not provided immediately in front of the trigger image and the reference patch is formed, when compared with the configuration in which the patch gaps are provided in all the gaps between the reference patches, the number of patch gaps can be kept to a minimum, and the spaces corresponding to the neglected patch gaps can be saved. Even in the test pattern image 4-3, when the reference patch corresponds to the entry shock corresponding portion, as with the test pattern image 4-1, the reference patch is not provided only in the entry shock corresponding portion, but the patch gap is provided. Further, the patch gap is widened so as to avoid the entry shock corresponding portion. Therefore, the image density adjustment can be performed with no influence of the entry shock.

Thus, the system in which the influence of the entry shock is avoided by providing the patch gap in the test pattern image is described as shown in FIG. 4. The test pattern image is not limited to the system shown in FIG. 4. It is also possible to use test pattern images shown in FIGS. 5 and 6. In the test pattern images shown in FIGS. 5 and 6, in the case where the reference patch exists at the position opposite the density sensor 9 when the recording medium front-end reaches the entry shock generating portion, i.e. in the case where the reference patch exists at the position affected by the entry shock, the density sensor 9 does not detect the reference patch, or the output value of the reference patch is not utilized for the image density adjustment even if the density sensor 9 detects the reference patch. Therefore, the influence of the entry shock can be avoided to perform the image density adjustment with high accuracy.

In test pattern images 5-1, 5-2, and 5-3 shown in FIG. 5, the reference patches having the same sizes are arranged at regular intervals. The density sensor 9 does not detect reference patch located at the entry shock corresponding portion affected by the entry shock, or the output value of the reference patch is not utilized for the image density adjustment even if the density sensor 9 detects the reference patch. The density sensor 9 detects the density of the same patch provided immediately behind the reference patch in the entry shock corresponding portion (or the same patch in another position), and the output value of the reference patch is utilized for the image density adjustment. Therefore, the influence of the vertical fluctuation in the recording medium by the entry shock can be avoided, and the image density adjustment can be performed with high accuracy.

In the test pattern image 5-1 shown in FIG. 5, as described above, the reference patches having the same sizes are arranged at regular intervals, each reference patch is formed behind each trigger image, and the gap is provided between the reference patch and the next trigger image. Further, the configuration described in FIG. 4 is also combined in the test pattern image 5-1. Namely, the test pattern image 5-1 also has the configuration, in which the reference patch is not formed but the patch gap is provided in the entry shock corresponding portion affected by the entry shock. In the test pattern image 5-2, the reference patches having the same sizes are arranged at regular intervals, and the plural reference patches are continuously formed behind one trigger image while the gap is not provided. In the test pattern image 5-3, the reference patches having the same sizes are arranged at regular intervals, one reference patch is formed behind one trigger image while the patch gap is not provided, and the reference patches and the trigger images are continuously formed while alternately arranged.

In test pattern images 6-1, 6-2, and 6-3, the reference patch in the entry shock corresponding portion affected by the entry shock is larger than other reference patches. In the larger reference patch, the density detection is performed at the point which is not affected by the entry shock while the timing is off from the point which is affected by the entry shock. Therefore, the influence of the vertical fluctuation in the recording medium by the entry shock can be avoided, and the image density adjustment can be performed with high accuracy.

In the test pattern image 6-1 shown in FIG. 6, the reference patch in the entry shock corresponding portion affected by the entry shock is larger than other reference patches, one reference patch is formed behind one trigger image, and the gap is formed between the reference patch and the next trigger image. Further, the configuration described in FIG. 4 is also combined in the test pattern image 6-1. Namely, the test pattern image 6-1 also has the configuration, in which the reference patch is not formed but the patch gap is provided in the entry shock corresponding portion affected by the entry shock. In the test pattern image 6-2, the reference patch in the entry shock corresponding portion is larger than other reference patches, and the plural reference patches including the larger reference patch are continuously formed behind one trigger image while the gap is not provided. In the test pattern image 6-3, the reference patch in the entry shock corresponding portion is larger than other reference patches, one reference patch (including the reference patch) is formed behind one trigger image while the patch gap is not provided, and the reference patches and the trigger images are continuously formed while alternately arranged.

In the embodiment, the density sensor 9 is provided in the sheet re-feeding path 67. The invention is not limited to the configuration of the embodiment. For example, it is also possible that the density sensor which is of the image density detection means is arranged in another recording medium conveyance path. In the image forming apparatus including an automatic document feeder and the document reading means, while the automatic document feeder conveys the recording medium in which the test pattern image is already formed, the document reading means is utilized as the density sensor to detect the image density, and the image density adjustment may be performed based on the detection information.

The image forming apparatus in which the electrophotographic type is utilized is illustrated in the embodiment. However, the invention is not limited to the electrophotographic type. For example, in the image forming apparatus in which the electrophotographic type is utilized, it is possible that the density is detected with the same test pattern image to perform the image density adjustment based on the detection information. Therefore, the influence of the vertical fluctuation in the recording medium can be avoided when the recording medium front-end enters the entry shock generating portions such as the bent conveyance path, the roller pair, a sensor flag, and the discharge tray, which allows the image density adjustment to be performed with high accuracy.

In the density sensor 9, it is possible that white light, red light, blue light, and green light of LED, a halogen lamp, a xenon lamp, and the like which are of the irradiation means are used as reference light of the sensor. It is possible that a CCD, a photodiode, a photo multiplier a CMOS sensor are used as light reception means.

In the embodiment, the test pattern image has the trigger image for starting the density detection of the reference patch. However, the invention is not limited to the test pattern image of the embodiment. For example, it is possible that the test pattern image does not have the trigger image but have only the reference patch. In this case, it is possible that the density is detected at the desired timing from a certain reference for the plural reference patches. Specifically it is possible that the detection means (already-existing sensor or separately installed sensor) located on the upstream side of the density sensor in the conveyance direction is utilized to start the density detection of the reference patch in the test pattern image at predetermined timing based on the detection of the detection means. Therefore, the density detection can be started without providing the trigger image. Even if the test pattern image includes only the reference patch, as described above, the influence of the vertical fluctuation in the recording medium can be avoided when the recording medium front-end enters the entry shock generating portions, and the image density adjustment can be performed with high accuracy.

As described above, according to the embodiment, in the image forming apparatus which can detect the image density of the recording medium during the conveyance to perform the image density adjustment, the image forming apparatus in which the influence of the vertical fluctuation in the recording medium is avoided to perform the density adjustment with high accuracy and the low cost and the downsizing are achieved can be provided.

CROSS-REFERENCE TO RELATED APPLICATION

This application claims the benefit of priority from the prior Japanese Patent Application No. 2004-132961 filed on Apr. 28, 2004 the entire contents of which are incorporated herein by reference.

What is claimed is:

1. An image forming apparatus comprising:

an image forming portion which forms an image on a sheet, wherein the image forming portion can form a test pattern image on the sheet and the test pattern image having a reference image formed in a predetermined density;

sheet conveyance path which conveys the sheet on which the image is formed by the image forming portion;

image density detection means disposed on said sheet conveyance path for detecting density of the test pattern image formed on the sheet; and control means for performing density adjustment of the image formed on the sheet by the image forming portion based on a detection information of the image density detection means, wherein the image forming portion forms the test pattern on the sheet such that the reference image is not formed at positions in the sheet, the positions are located at the same distances away from a front end of the sheet in a conveyance direction as distances along the conveyance path between the image density detection means and points where entry shock of the sheet front end is generated in the sheet conveyance path on the downstream side of the image density detection means.

2. An image forming apparatus according to claim 1, wherein the test pattern image has a plurality of reference images, and the position where the reference image of the test pattern image is not formed is a gap between the reference images.

3. An image forming apparatus according to claim 1, wherein the test pattern image has a plurality of reference images, the gap exists between the adjacent reference images in the plurality of reference images, and the gap between the reference images provided at the position where the reference image of the test pattern image is not formed is broader than other gaps between the reference images.

4. An image forming apparatus according to claim 1, wherein the test pattern image has a trigger image for starting detection of the reference image, and the trigger image is arranged at the position where the reference image is not formed.

5. An image forming apparatus according to any one of claims 1 to 4, wherein said sheet conveyance path is a sheet re-feeding path which conveys the sheet on which the image is formed on a first surface to the image forming portion again in order to form the images on a second surface of the sheet, and the image density detection means is arranged in the sheet re-feeding path.

6. An image forming apparatus according to claim 1, wherein the image density detection means is arranged in a guide member located on the side opposite a sheet image forming surface in a pair of guide members forming the sheet conveyance path, and any one of the pair of guide members has a pressing member which presses the sheet at the position where the image density detection means is arranged.

7. An image forming apparatus according to claim 1, wherein detection means is provided on the upstream side of the image density detection means, and the image density detection means starts the detection of the reference image based on the detection of the detection means.

8. An image forming apparatus comprising:

an image forming portion which forms an image on a sheet, wherein the image forming portion can form a test pattern image on the sheet and the test pattern image having a reference image formed in a predetermined density;

sheet conveyance path which conveys the sheet on which the image is formed by the image forming portion;

image density detection means disposed on said sheet conveyance path for detecting density of the test pattern image formed on the sheet; and control means for performing density adjustment of the image formed on the sheet by the image forming portion based on a detection information of the image density detection means, wherein the image density detection means does not perform the density detection of the reference image in the test pattern image, when a front end of the sheet in a conveyance direction is located at positions where entry shock of the sheet front end is generated in a sheet conveyance path on the downstream side of the image density detection means.

9. An image forming apparatus according to claim 8, wherein the test pattern image has a plurality of reference images, the same reference images are provided immediately behind the reference image in which the density detection is not performed, the density detection is performed to the same reference images, and the detected density detection information is used for the image density adjustment.

10. An image forming apparatus according to claim 8, wherein the test pattern image has the plurality of reference images, and the reference image in which the density detection is not performed is set larger than other reference images with respect to the sheet conveyance direction.

11. An image forming apparatus according to any one of claims 8 to 10, wherein said sheet conveyance path is a sheet re-feeding path which conveys the sheet on which the image is formed on a first surface to the image forming portion again in order to form the images on a second surface of the sheet, and the image density detection means is arranged in the sheet re-feeding path.

12. An image forming apparatus according to claim 8, wherein the image density detection means is arranged in a guide member located on the side opposite a sheet image forming surface in a pair of guide members forming the sheet conveyance path, and any one of the pair of guide members has a pressing member which presses the sheet at the position where the image density detection means is arranged.

13. An image forming apparatus comprising:

an image forming portion which forms an image on a sheet, wherein the image forming portion can form a test pattern image on the sheet and the test pattern image having a reference image formed in a predetermined density;

sheet conveyance path which conveys the sheet on which the image is formed by the image forming portion;

image density detection means disposed on said sheet conveyance path for detecting density of the test pattern image formed on the sheet; and control means for performing density adjustment of the image formed on the sheet by the image forming portion based on a detection information of the image density detection means, wherein the control means does not use the density detection information as the image density adjustment, even if the image density detection means detects the density of the reference image in the test pattern image, when a front end of the sheet in a conveyance direction is located at positions where entry shock of the sheet front end is generated in a sheet conveyance path on the downstream side of the image density detection means.

14. An image forming apparatus according to claim 13, wherein the test pattern image has a plurality of reference images, the same reference images are provided immediately behind the reference image in which the density detection information is not used for the image density adjustment even if the density detection is performed, the density detection is performed to the same reference images, and the detected density detection information is used for the image density adjustment.

15. An image forming apparatus according to claim 13, wherein the test pattern image has a plurality of reference images, and the reference image, in which the density detection information is not used for the image density adjustment even if the density detection is performed, is set larger than other reference images with respect to the sheet conveyance direction.

16. An image forming apparatus according to any one of claims 13 to 15, wherein said sheet conveyance path is a sheet re-feeding path which conveys the sheet on which the image is formed on a first surface to the image forming portion again in order to form the images on a second surface of the sheet, and the image density detection means is arranged in the sheet re-feeding path.

17. An image forming apparatus according to claim 13, wherein the image density detection means is arranged in a guide member located on the side opposite a sheet image forming surface in a pair of guide members forming the sheet conveyance path, and any one of the pair of guide members has a pressing member which presses the sheet at the position where the image density detection means is arranged.

* * * * *

UNITED STATES PATENT AND TRADEMARK OFFICE

CERTIFICATE OF CORRECTION

PATENT NO. : 7,228,083 B2
APPLICATION NO. : 11/114157
DATED : June 5, 2007
INVENTOR(S) : Tadashi Iwakawa It is certified that error appears in the above-identified patent and that said Letters Patent is hereby corrected as shown below:

COLUMN 2:
Line 14, “is” should read --are--.

COLUMN 5:
Line 64, “of” should read --of the--.

COLUMN 7:
Line 34, “can” should read --can be--.

COLUMN 12:
Line 1, “multiplier a CMOS sensor are” should read --multiplier, or a CMOS sensor is--.
Line 8, “have” should read --has instead--.

Signed and Sealed this

Thirteenth Day of May, 2008

JON W. DUDAS
*Director of the United States Patent and Trademark Office*